US005099171A

United States Patent [19]

Daiku et al.

[11] Patent Number: 5,099,171

[45] Date of Patent: Mar. 24, 1992

[54] CATHODE-RAY TUBE PANEL HAVING THIN CONDUCTIVE FILM

[75] Inventors: Nobutaka Daiku; Keisuke Okada, both of Hikone, Japan

[73] Assignee: Nippon Electric Glass Co., Ltd., Otsu, Japan

[21] Appl. No.: 465,177

[22] PCT Filed: Aug. 8, 1988

[86] PCT No.: PCT/JP88/00786

§ 371 Date: Feb. 26, 1990

§ 102(e) Date: Feb. 26, 1990

[87] PCT Pub. No.: WO90/01790

PCT Pub. Date: Feb. 22, 1990

[51] Int. Cl.[5] ..... H01J 9/20; H01J 29/88

[52] U.S. Cl. ..... 313/479; 313/478; 220/2.1 A; 445/14

[58] Field of Search ..... 313/477, 478, 479; 358/245, 252; 220/2.1 A, 2.3 R; 445/14

[56] References Cited

U.S. PATENT DOCUMENTS 2,820,166 1/1958 Pinotti ..... 313/482 X 4,731,558 3/1988 Haisma et al. ..... 313/478

*Primary Examiner*—Sandra O'Shea

*Attorney, Agent, or Firm*—Armstrong, Nikaido, Marmelstein, Kubovcik & Murray

[57] ABSTRACT

A cathode-ray tube panel, wherein the outer surface (12) of the cathode-ray tube panel (10) is made in the form of a roughened surface (14) having microscopic irregularities and the roughened surface is formed with a thin electrically conductive film (15) made of $SnO_2$ and $Sb_2O_3$, thereby making the panel both antistatic and antireflective.

5 Claims, 2 Drawing Sheets

CATHODE-RAY TUBE PANEL HAVING THIN CONDUCTIVE FILM

TECHNICAL FIELD

This invention relates to a cathode-ray tube panel or face plate, and more particularly it relates to a cathode-ray tube panel having both antistatic and antireflective properties imparted to its outer surface and also to a method for producing the same.

BACKGROUND ART

Generally, a cathode-ray tube operates with a high voltage applied thereto, with the result that static electricity is generated on the outer surface of the panel upon switching or at other times, such static electricity causing dust to stick to the outer surface of the panel to degrade visibility or giving shock to a person when his hands touch the outer surface of the panel. There is another problem that incident light is reflected by the outer surface of a cathode-ray tube panel, also degrading visibility. Therefore, in cathode-ray tubes, particularly those for display purposes, it is desired to impart antistatic and antireflective properties to the outer surface of the panel.

For example, provision of a transparent electrically conductive metal film of tin oxide $SnO_2$ on the back surface of a panel to prevent buildup of static electricity is disclosed in Japanese Utility Model Publication No. 8515/1969 and Japanese Patent Application Disclosure No. 94337/1984. Such $SnO_2$ film, however, can be a cause of reflection of light on the front surface of the panel. Although various suggestions intended to prevent either buildup of static electricity or reflection of light have heretofore been made, there has no cathode-ray tube panel which achieves prevention of both buildup of static electricity and reflection of light.

DISCLOSURE OF THE INVENTION

This invention is intended to provide a cathode-ray tube panel having both antistatic and antireflective properties, characterized in that the outer surface of the glass panel is made in the form of a roughened surface having microscopic irregularities, said roughened surface being formed with a thin electrically conductive film made mainly of tin oxide $SnO_2$ while retaining the shape of the irregularities of the roughened surface.

These and other features of the invention will become more apparent from the following description when taken in conjunction with the accompanying drawings.

BEST MODE FOR CARRYING OUT THE INVENTION

Figure 1:
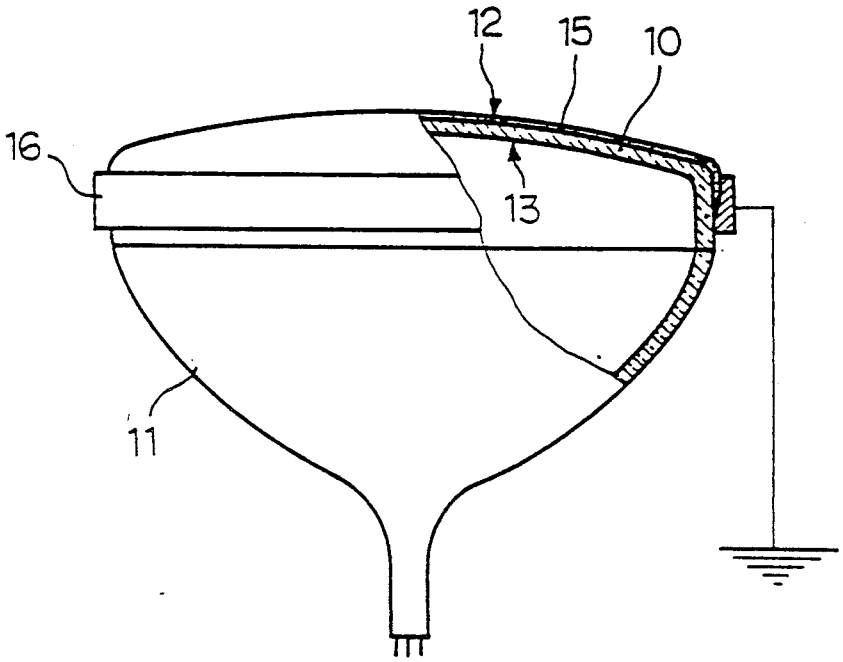
FIG. 1 is a side view, partly broken away, of a cathode-ray tube panel.
Figure 2:
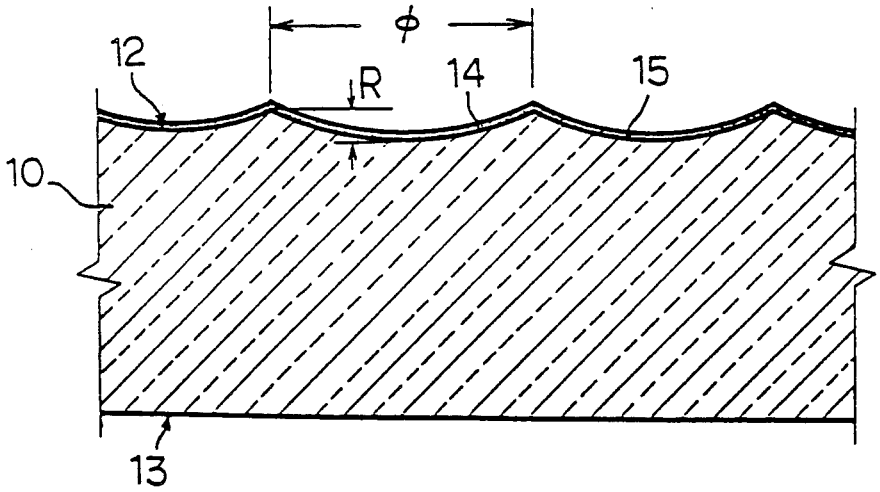
FIG. 2 is an enlarged sectional view of the principal portion of an embodiment of the invention.

FIG. 1 shows a cathode-ray tube in its entirety, wherein a glass panel 10 and a funnel 11 are fused together or fritted-glass-sealed together. The panel 10 has an outer surface 12 and an inner surface 13. FIG. 2 is an enlarged principal sectional view showing an embodiment of the invention, wherein the outer surface 12 of the panel 10 is made in the form of a roughened surface 14 having microscopic irregularities, said roughened surface being coated with a thin electrically conductive film 15 made mainly of tin oxide $SnO_2$ while retaining the shape of the irregularities of the roughened surface 14. The material of the film 15 consists mainly of tin oxide $SnO_2$, with a slight amount of antimony oxide $Sb_2O_3$ added thereto. This is for the purpose of reducing the electric resistance of the film 15, the amount of $Sb_2O_3$ added ranging from 0.1% to 4%, preferably from 0.2% to 2% with respect to $SnO_2$.

Figure 3:
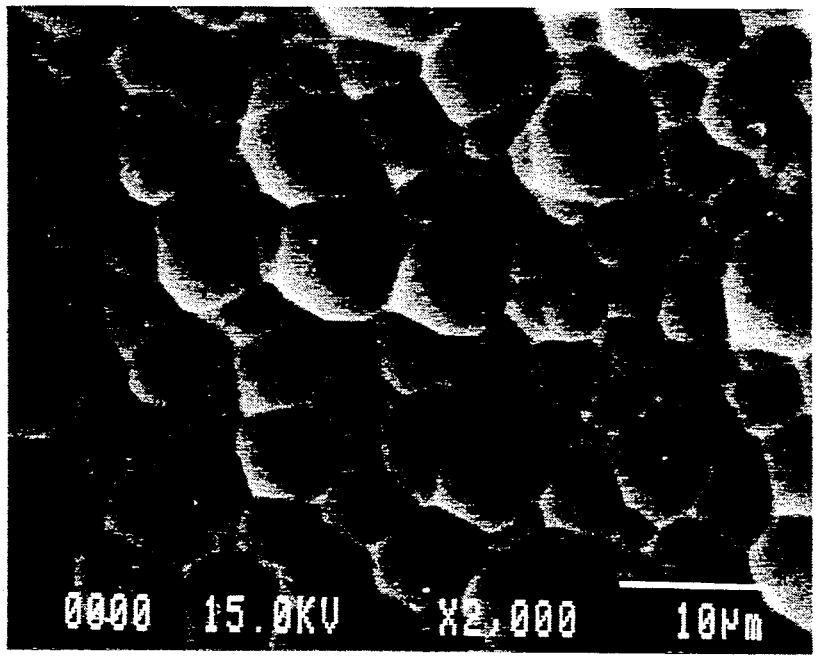
FIG. 3 is a microphotograph showing a roughened outer surface of a panel before it is formed with an electrically conductive film.

From the standpoint of antireflective effect, the irregularities of the roughened surface 14 (FIGS. 2 and 3) forming the outer surface of the panel 10 would have no have an average diameter of not less than $3\mu$ and an average roughness R of not more than $2\mu$; however, it is preferable that the average diameter be not more than $40\mu$ (desirably not more than $20\mu$) and the average roughness R be not more than $2\mu$ (desirably not more than $1\mu$). Outside these ranges, resolving power would be reduced to the extent that the product can no longer be put to practical use.

Figure 4:
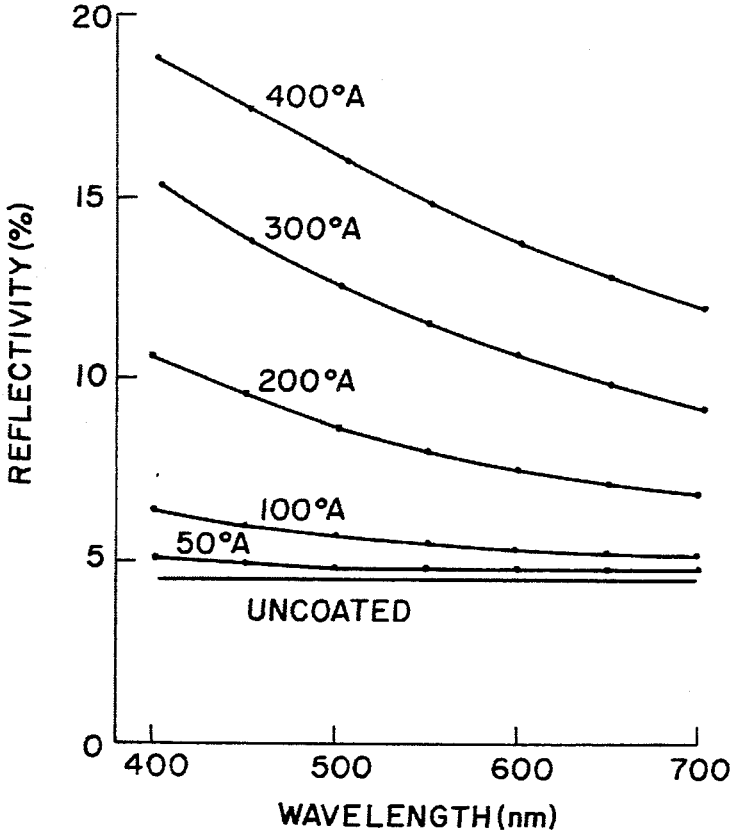
FIG. 4 is a graph showing the relation between the thickness of an $Sn_2$ film on the outer surface of a panel and reflectivity.

The thickness of the film 15 ranges from 10 Å to 500 Å, preferably from 50 Å to 150 Å, while the film resistance should properly range from $10^8$ to $10^{11}$ Ω/□. If the film thickness is less than 10 Å, the resistance would be too high to provide sufficient antistatic effect, while if the film thickness exceeds 150 Å, the reflectivity of the panel glass would be increased to the extent of making it difficult to see images. If the film thickness exceeds 500 Å, not only would reflectivity be increased to the extent of losing the antireflective effect provided by the roughened surface but also color shading would be caused in images, thus making the panel no longer useful. The relation between film thickness and reflectivity can be understood from FIG. 4 which shows reflectivity where comparison is made between an uncoated, or mirror-surfaced panel and panels coated with $SnO_2$ films of different thicknesses.

The intensity of reflected light from a cathode-ray tube panel identified by the following factors was measured using a gonio-photometer; it was found that with a value of 100 assigned to the intensity of reflected light from a panel having mirror-polished outer surface, a value of 20 was obtained, proving that a satisfactory antireflective effect had been attained.

Film material: 99.6% $SnO_2$, 0.4% $Sb_2O_3$

Film thickness: 100 Å

Panel surface: average diameter $8\mu$ average roughness $0.8\mu$

A method of producing a cathode-ray tube panel according to the invention will now be described.

The panel is fabricated from molten glass by press molding known per se. And sand is blown against the mirror-polished outer surface of the panel and then the panel is immersed in an etching solution of sulfurous acid. Thereby, the outer surface of the panel takes the form of a roughened surface having microscopic irregularities. The same result may also be obtained by immersing the mirror-polished outer surface of the panel in a solution of ammonium fluoride and then in a solution of hydrofluoric acid or fluorosulfric acid. Other methods of forming a roughened surface includes a solely mechanical method and a method in which the pattern of the roughened surface of a metal mold is transferred to a glass molding during the glass molding step.

The next step is to form a thin electrically conductive film on the roughened surface of the panel. A chemical vapor deposition process is most suitable for this step. For example, a gas resulting from heating and vaporizing a mixture of dimethyltin dichloride $(CH_3)_2 SnCl_2$ and antimony trichloride $SbCl_3$ is blown against the outer surface of the panel, followed by gradual cooling to form a thin film. Said preheating should be controlled so that the panel temperature immediately prior to the blowing of vapor ranges from 400° C. to 500° C., preferably from 430° C. to 470° C. Without being restricted by this example, other organic or inorganic tin compounds may be used, and film formation may be effected by using an immersion method, spinning method or the like.

After the outer surface of the panel has been roughened to have microscopic irregularities as described above, a thin film is formed on said roughened surface while retaining the shape of the irregularities, thereby providing a cathode-ray tube panel having both antistatic and antireflective properties. In addition, of the outer surface of the panel, only the front effective area is sufficient for the place where the electrically conductive film 15 is to be provided for antistatic purposes; however, it may be extended to cover the lateral surface, as is the case with the arrangement shown in FIG. 1. In that case, the electrically conductive film 15 will be electrically connected to a metal band 16 installed on the lateral surface for ensuring prevention of explosion and is thereby grounded; thus, this is advantageous since the need for a separate grounding element is saved.

What is claimed is:

1. A cathode-ray tube panel of glass, wherein the outer surface is roughened to have microscopic irregularities, the roughened surface being formed with an electrically conductive film having a thickness ranging from 10 Å and made mainly of $SnO_2$ with $Sb_2O_3$ added thereto, the average diameter of the irregularities of the roughened surface ranging from 3μ to 40μ, the average roughness ranging from 0.3μ to 2μ, the amount of $Sb_2O_3$ with respect to the amount of $SnO_2$ ranging from 0.1% to 4%.

2. A cathode-ray tube panel as set forth in claim 1, wherein the electrically conductive film is formed on the entire outer surface of the panel.

3. A cathode-ray tube panel as set forth in claim 1, wherein the thickness of the electrically conductive film ranges from 50 Å to 150 Å.

4. A method of producing cathode-ray tube panels, comprising the steps of press-molding a panel of predetermined shape from molten glass, roughening the outer surface of the panel by a solution of hydrofluoric acid to impart microscopic irregularities thereto such that the average diameter ranges from 3μ to 40μ and the average roughness ranges from 0.3μ to 2 μm, preheating the panel to a temperature ranging from 400° C. to 500° C. blowing vapor of tin oxide and ammonium oxide against the outer surface of the panel to form a film having a thickness ranging from 10 Å to 500 Å, and slowly cooling the panel.

5. A method of producing cathode-ray tube panels as set forth in claim 4, wherein the preheating is controlled so that the temperature of the panel immediately prior to the blowing of vapor ranges from 430° C. to 470° C.

* * * * *